US007942120B2

(12) United States Patent
Zhou

(10) Patent No.: US 7,942,120 B2
(45) Date of Patent: May 17, 2011

(54) VARIABLE CAMSHAFT TIMING SYSTEM

(75) Inventor: Quanbao Zhou, Rugby (GB)

(73) Assignee: Ford Global Technologies, LLC, Dearborn, MI (US)

( * ) Notice: Subject to any disclaimer, the term of this patent is extended or adjusted under 35 U.S.C. 154(b) by 478 days.

(21) Appl. No.: 12/047,536

(22) Filed: Mar. 13, 2008

(65) Prior Publication Data

US 2008/0264364 A1 Oct. 30, 2008

(30) Foreign Application Priority Data

Apr. 26, 2007 (GB) ..... 0708080.7

(51) Int. Cl.
*F01L 1/34* (2006.01)

(52) U.S. Cl. ..... 123/90.17; 123/90.15; 464/160

(58) Field of Classification Search ..... 123/90.15, 123/90.17, 90.12, 90.13, 90.16, 90.18; 137/511, 137/625.69; 464/1, 2, 160
See application file for complete search history.

(56) References Cited

U.S. PATENT DOCUMENTS

| | | | | |
|---|---|---|---|---|
| 4,858,572 | A * | 8/1989 | Shirai et al. | 123/90.12 |
| 5,218,935 | A | 6/1993 | Quinn, Jr. et al. | |
| 5,979,163 | A | 11/1999 | Hanners et al. | |
| 6,047,674 | A | 4/2000 | Kadowaki et al. | |
| 6,477,996 | B2 * | 11/2002 | Ogawa | 123/90.15 |
| 7,000,580 | B1 | 2/2006 | Smith et al. | |

FOREIGN PATENT DOCUMENTS

| | | |
|---|---|---|
| EP | 1455057 | 9/2004 |
| GB | 1179011 | 1/1970 |

* cited by examiner

*Primary Examiner* — Ching Chang
(74) *Attorney, Agent, or Firm* — Allan J. Lippa; Alleman Hall McCoy Russell & Tuttle LLP

(57) ABSTRACT

A variable camshaft timing (VCT) system for an internal combustion engine is described. In one example, the system includes a spool valve that displaces oil from one phaser chamber to another phaser chamber when the spool valve is moved. The system may respond faster than systems that employ a pump to move oil between phaser chambers.

14 Claims, 4 Drawing Sheets

VARIABLE CAMSHAFT TIMING SYSTEM

FIELD

The present description relates to a variable camshaft timing system for an internal combustion engine.

BACKGROUND

It is known in the art to employ variable camshaft timing (VCT) systems in internal combustion engines for improved fuel economy, emissions, and performance. VCT systems operate to vary the relative phasing between a camshaft and a crankshaft to optimize the cam timing over the range of engine operation.

An example of a VCT is a dual oil feed vane-type VCT. A dual oil feed vane-type variable cam timing unit provides an inner member or hub that is fixably connected to an end face of a camshaft. The hub has a series of vanes which are captured in cavities or pressure chambers provided in an outer member which is concentrically mounted on the hub. The outer member incorporates a camshaft timing pulley which is powered by the crankshaft via a belt which is looped over the camshaft pulley and a crankshaft timing gear. The vanes circumferentially divide the pressure chambers into an advance side and a retard side. A spool valve, fluidly communicative with the pressure chambers via the inner member and the camshaft, controls the fluid pressure in the advance side and retard side of the pressure chambers. Hence, by controlling the fluid in the advance and retard pressure chambers, the angular position of the timing pulley versus the crankshaft can be varied.

A disadvantage of such a VCT utilizing oil pressure and flow to control the phase of the camshaft is that the VCT response rate is dependent on the oil temperature and engine speed in order to achieve desired fuel economy and emission benefits.

The inventor herein has developed a system that improves variable camshaft timing systems and ameliorates the above problem.

SUMMARY

According to a first aspect of the description there is provided a variable camshaft timing (VCT) system for an internal combustion engine, the VCT system comprising: a housing for accepting drive from a crankshaft of the engine; a rotor coaxially located within the housing for connection to a camshaft, the housing and the rotor defining at least one vane separating a chamber in the housing into a phaser advance chamber and a phaser retard chamber, the vane being capable of rotation to shift the relative angular positions of the housing and the rotor; and a control valve having a spool slidably located within a bore in a valve sleeve, wherein the spool comprises one land dividing the bore into a valve advance chamber and a valve retard chamber, with the valve retard chamber and the valve advance chamber both being connected to a hydraulic source, the valve advance chamber and the valve retard chamber being in hydraulic communication with the phaser advance chamber and the phaser retard chamber respectively through an advance line and a retard line, such that displacements of the spool push oil from a valve chamber to a phaser chamber and rotate the vane.

Preferably, the valve retard chamber and the valve advance chamber are connected to the hydraulic source through a first and a second feed line, each of them being provided with a check valve.

Preferably, the spool is connected to a control actuator for controlling movement of the spool relative to the valve sleeve based upon various engine parameters. Conveniently, the control actuator is a stepper motor or a solenoid.

The VCT system may further include a locking mechanism for locking the spool in position. The locking mechanism may include two solenoid valves disposed within the advance line and the retard line respectively and two additional feed lines, each solenoid valve being connected at one of its ends to its corresponding feed line and at its other end to its corresponding advance or retard line.

BRIEF DESCRIPTION OF THE DRAWINGS

The advantages described herein will be more fully understood by reading an example of an embodiment, referred to herein as the Detailed Description, when taken alone or with reference to the drawings, wherein.

DETAILED DESCRIPTION

Figure 1:
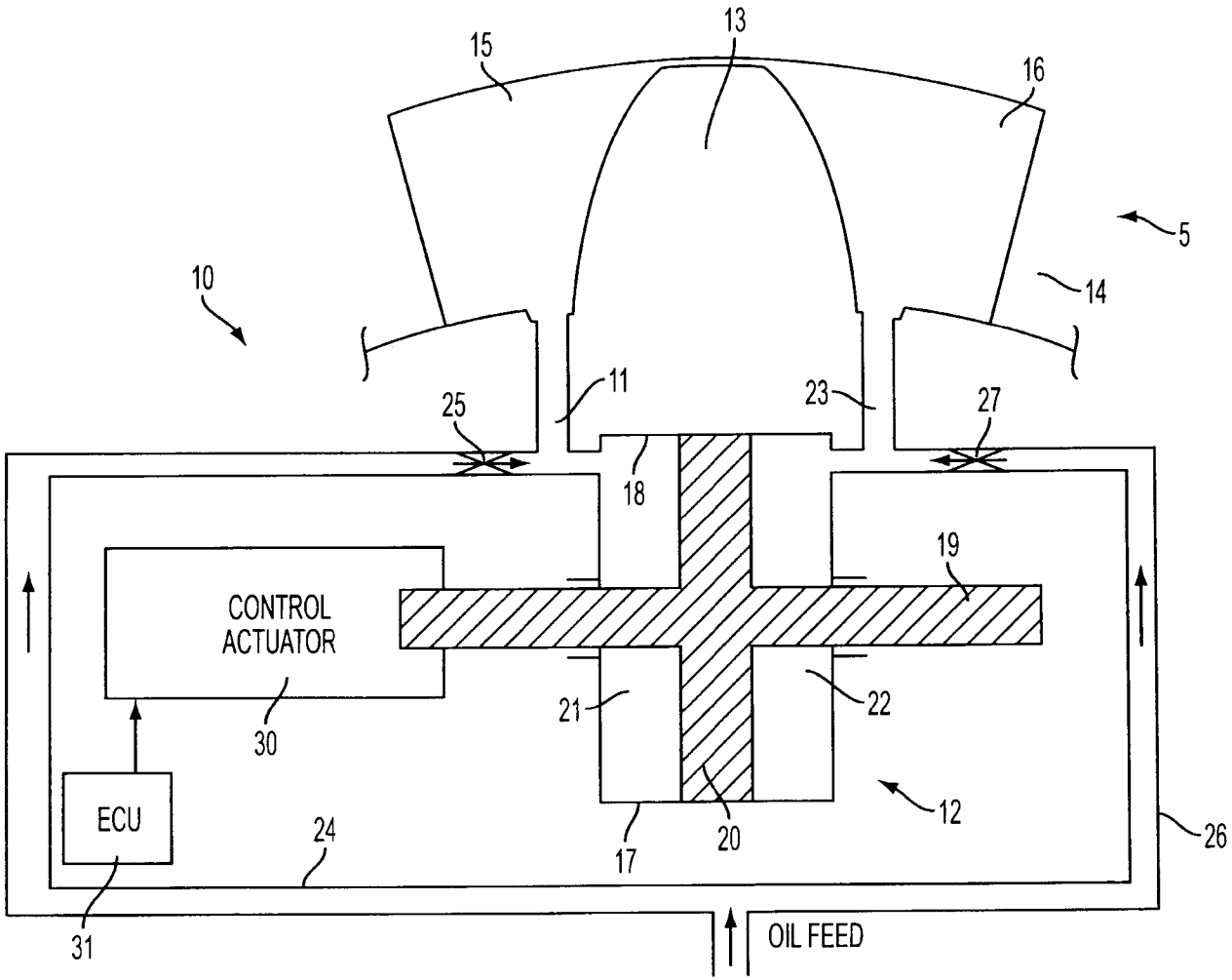
FIG. 1 is a schematic diagram of a VCT system according to the present invention showing a VCT phaser and a control valve each in a respective null position.
Figure 2:
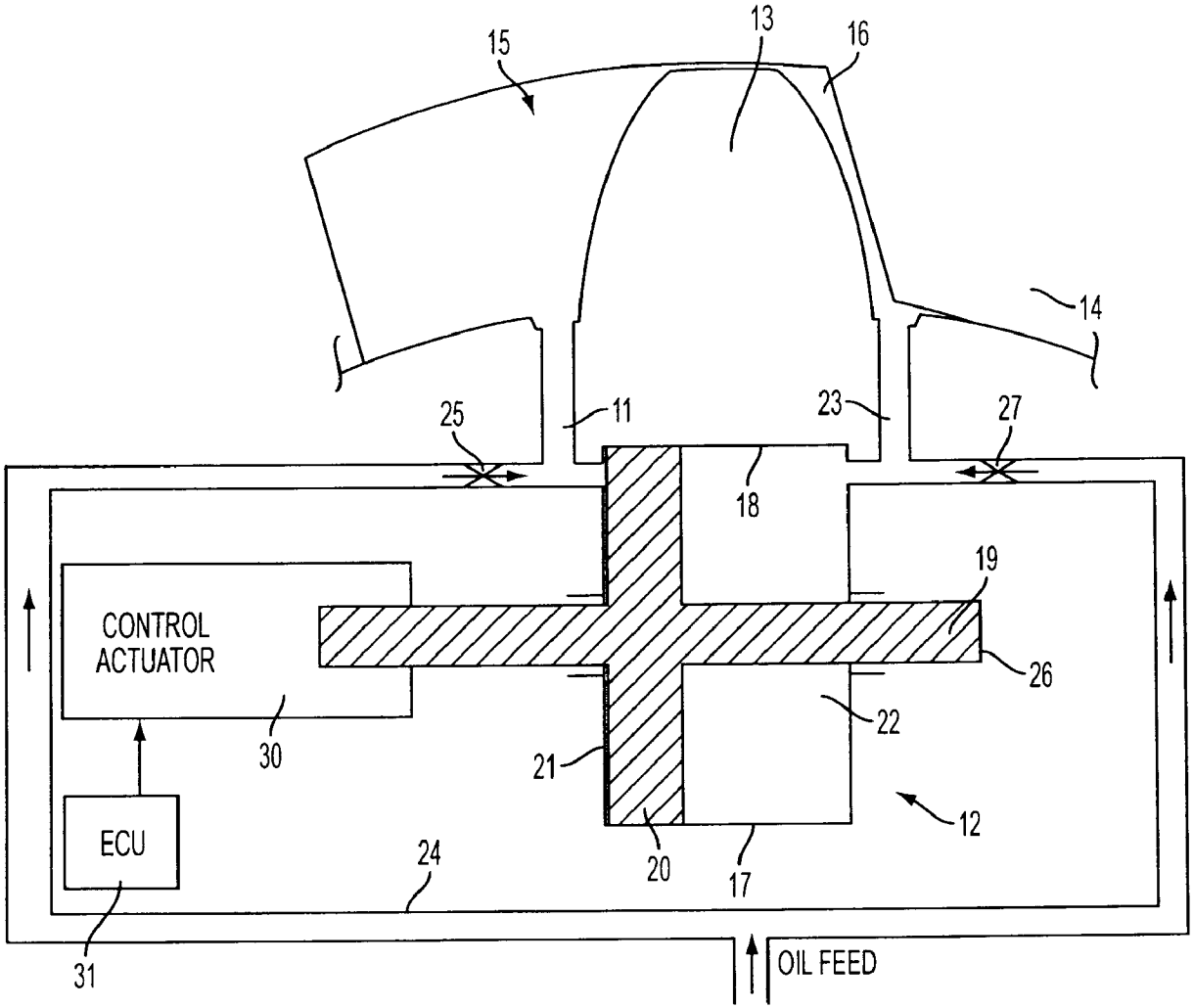
FIG. 2 is a view similar to FIG. 1 but with the VCT phaser and the control valve each in a respective fully advanced position.
Figure 3:
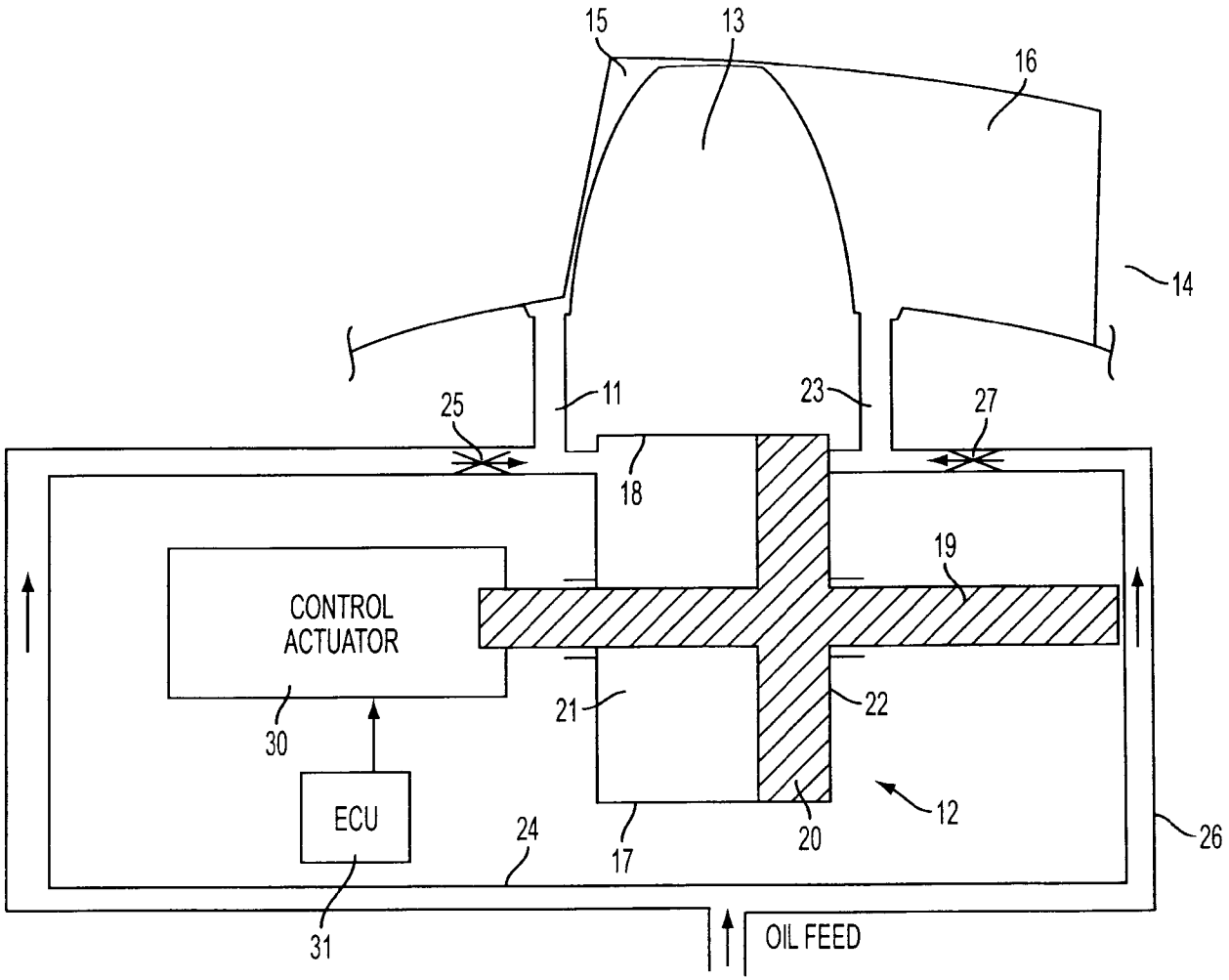
FIG. 3 is a view similar to FIG. 1 but with the VCT phaser and the control valve each in a respective fully retarded position.

With reference to FIGS. 1 to 3, there is shown in part a VCT system 10 for an internal combustion engine including in known manner a crankshaft, a camshaft (not shown) and a hydraulic oil supply, typically engine lubricating oil supplied by an engine driven pump. The VCT system 10 includes a vane phaser 11 mounted on the engine camshaft and a control valve 12. In a conventional way, the vane phaser 11 has a rotor with vanes, in this example one vane 13, mounted to the end of the camshaft, surrounded by a housing 14 provided with a vane chamber into which the vane 13 fits. Conventionally the housing has a pulley for accepting drive from the crankshaft. The vane chamber is divided into two separate chambers by the vane 13, respectively a phaser advance chamber 15 and a phaser retard chamber 16.

The control valve 12, located remotely from the phaser, includes a valve sleeve 17 having a bore 18 in which a stepped cylindrical spool 19 is slidable. The cylindrical spool 19 has one land 20 which cooperates with the bore 18 to divide the bore 18 into two chambers, respectively a valve advance chamber 21 and a valve retard chamber 22. The phaser advance chamber 15 and the valve advance chamber 21 are in hydraulic communication via an advance line 11. Similarly the phaser retard chamber 16 and the valve retard chamber 22 are in hydraulic communication via a retard line 23.

Engine oil is pumped to the advance line 11 through a first feed line 24, which incorporates a check valve 25, feeding both advance chambers 15, 21 with oil. Engine oil is also pumped directly to the retard line 23 through a second feed line 26 feeding thus both retard chambers 16, 22 with oil. The second feed line 26 incorporates a check valve 27.

As shown in FIG. 1, the volume of the phaser advance chamber 15, the volume of the advance line 11 and the volume of the valve advance chamber 21 together form an advance volume which is equal to a retard volume formed by the volume of the phaser retard chamber 16, the volume of the retard line 23 and the volume of the valve retard chamber 22. It will be appreciated that there is no hydraulic communication between the advance volume and the retard volume and that both these volumes are constant during operation of the spool 19 as it will further explained below.

A control actuator 30, for example a step motor, acts on one end of the spool 19 and controls movement of the spool 19 relative to the valve sleeve 17 under the control of an engine control unit (ECU) 31. This control actuator 30 is able to lock the spool 19 in position in to thereby lock the phaser vane 13 in position.

In operation, the spool 19 can be moved to various positions between the advanced position shown in FIG. 2 and the retarded position shown in FIG. 3 based upon various engine parameters monitored by the ECU 31 which utilizes this information to operate the control actuator 30. Hence, as shown FIG. 2, when the ECU 31 controls the control actuator 30, i.e. the step motor, to pull the spool 19 to the left from its null position (FIG. 2), the oil in the valve advance chamber 21 is pushed to the phaser advance chamber 15 while the oil in the phaser retard chamber 16 is pulled to the valve retard chamber 22, causing the vane 13 to advance. The control actuator 30 is then locked in position in order to avoid any further motion of the vane 13 toward the advance or retard direction.

Similarly, referring now to FIG. 3, when the ECU 31 controls the control actuator 30, i.e. the step motor, to pushes the spool 19 to the right from its null position (FIG. 1), the oil in the valve retard chamber 22 is pushed to the phaser retard chamber 16 while the oil in the phaser advance chamber 15 is pulled to the valve advance chamber 21, causing the vane 13 to retard. Then the control actuator 30 is locked in position in order to avoid any further motion of the vane 13 toward the retard or advance direction.

The present description allows the position of the angle of the phaser vane 13 to be determined directly by the position of the spool 19. Further, the vane's moving speed can be increased as compared to a conventional VCT system in which oil is pumped from the phaser advance chamber to the phaser retard chamber because moving the spool is not dependant on the volumetric capacity of the pump.

Figure 4:
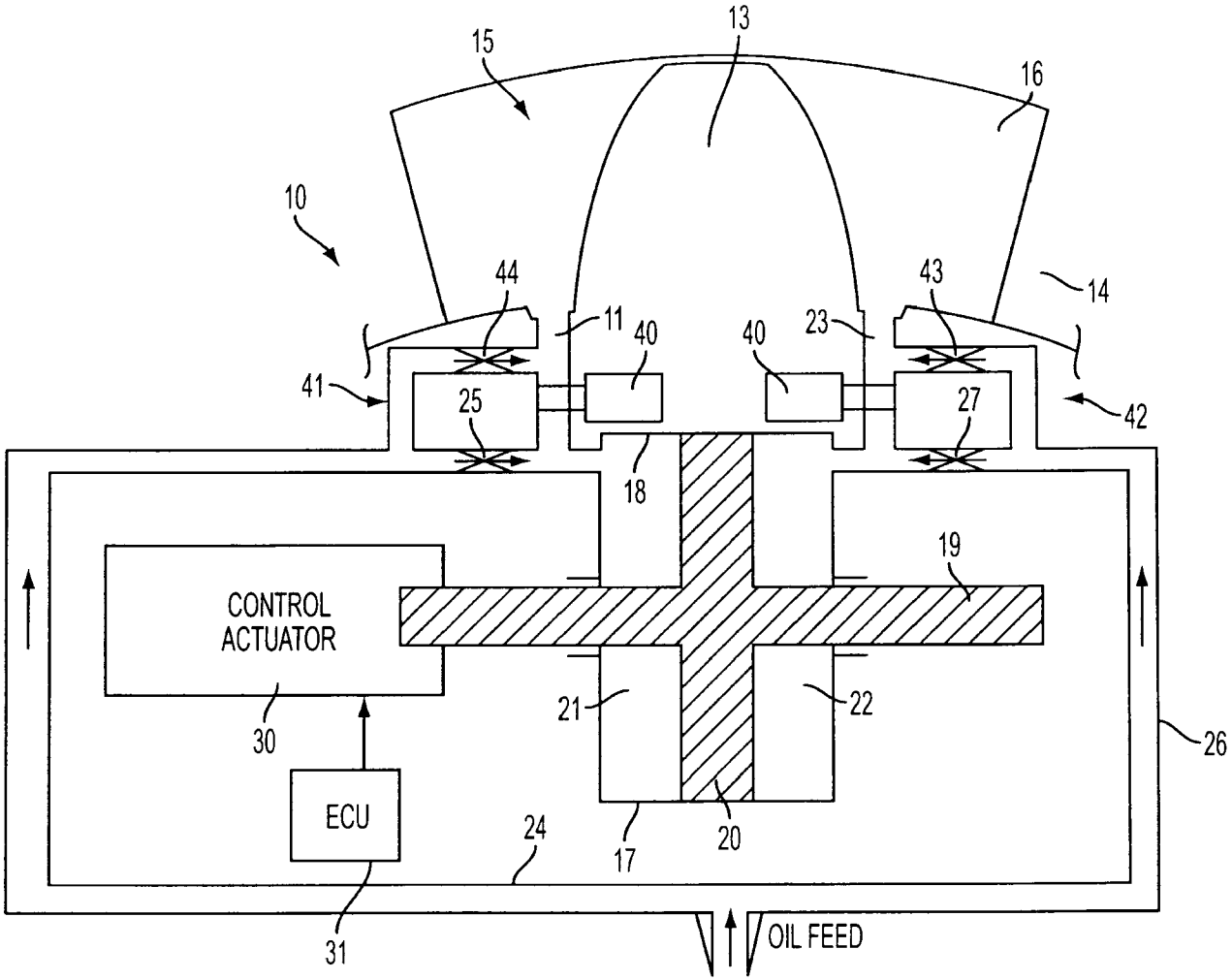
FIG. 4 is a view similar to FIG. 1 showing a modification to the VCT system showing in FIGS. 1 to 3.

Referring now to FIG. 4, there is shown a modification of the VCT system 10 shown in FIGS. 1 to 3. The VCT system 10 in FIG. 4 is further provided with a locking mechanism preventing the vane 13 from retarding or advancing further depending on the engine operations. The locking mechanism includes two solenoid valves 40 respectively disposed within the advance line 11 and the retard line 23 and two additional feed lines 41, 42, each incorporating a check valve 43, 44. The first additional feed line 41 is connected at one end to the first feed line 24 and at the other end to the advance line 11 in such a way that one of the solenoid valve 40 is disposed between the two check valves 44, 25. Similarly the second additional feed line 42 is connected at one end to the second feed line 26 and at the other end to the retard line 23 in such a way that the other solenoid valve 40 is disposed between two check valves 43, 27.

It will be noted that in another modification of the VCT shown in FIG. 4, the VCT system 10 can be provided with only two check valves, each check valve being located within the first and second feed lines.

In operation, when the ECU 31 monitors that the angle of the vane 13 needs to be changed, the ECU 31 commands the two solenoid valves 40 toward the open position and then the spool 19 is moved by the control actuator 30 to thereby move the vane 13 to a new position. At this new position, the ECU 31 closes the two solenoid controlled valves 40 ensuring thus that the VCT phaser is locked.

Although the above examples describe a step motor as a control actuator, it will be appreciated that the control actuator may be a solenoid or another type of motor driving through a self-locking system such as a worm gear.

I claim:

1. A variable camshaft timing (VCT) system for an internal combustion engine, the VCT system comprising:

a housing for accepting drive from a crankshaft of the engine;

a rotor coaxially located within the housing for connection to a camshaft, the housing and the rotor defining at least one vane separating a chamber in the housing into a phaser advance chamber and a phaser retard chamber, the vane being capable of rotation to shift relative angular positions of the housing and the rotor; and a control valve having a spool slidably located within a bore in a valve sleeve, the spool positioned in the valve sleeve such that the spool moves oil between a valve advance chamber and the phaser advance chamber when the spool is moved, the spool further moving oil between a valve retard chamber and the phaser retard chamber when the spool is moved.

2. A VCT system as claimed in claim 1, in which the valve retard chamber and the valve advance chamber both are connected to a hydraulic source through a first and a second feed lines, each of said first and second feed lines being provided with a check valve.

3. A VCT system as claimed in claim 1, in which the spool is connected to a control actuator for controlling movement of the spool relative to the valve sleeve based upon various engine parameters.

4. A VCT system as claimed in claim 3, wherein the control actuator is a stepper motor or a solenoid.

5. A VCT system as claimed in claim 1 wherein the VCT system further includes a locking mechanism for locking the spool in a position.

6. A VCT system as claimed in claim 5, in which the locking mechanism includes two solenoid valves disposed within an advance line and a retard line respectively and two additional feed lines, each solenoid valve being connected at one of its ends to its corresponding feed line and at its other end to its corresponding advance or retard line.

7. A VCT system as claimed in claim 6, in which each additional feed line incorporates a check valve.

8. The system of claim 1 wherein the valve advance chamber is substantially empty of oil when the spool is in an advance position.

9. A variable camshaft timing (VCT) system for an internal combustion engine, the VCT system comprising:

a housing for accepting drive from a crankshaft of the engine;

a rotor coaxially located within the housing for connection to a camshaft, the housing and the rotor defining at least one vane separating a chamber in the housing into a phaser advance chamber and a phaser retard chamber, the vane being capable of rotation to shift relative angular positions of the housing and the rotor; and a control valve having a spool slidably located within a bore in a valve sleeve, the spool positioned in the valve sleeve such that the spool moves oil between a valve advance chamber and the phaser advance chamber when the spool is moved, the spool further moving oil between a valve retard chamber and the phaser retard chamber when the spool is moved; and a control actuator coupled to the control valve such that force applied by the actuator to the spool is applied to oil in the valve advance chamber and oil in the valve retard chamber to move the rotor.

10. The system of claim 9 wherein the spool is configured to pull oil from the advance valve chamber to the advance phaser chamber.

11. The system of claim 9 further comprising a valve in an advance line and a valve in a retard line to limit rotation of the vane.

12. The system of claim 9 wherein oil is supplied to the valve advance chamber and retard valve chamber by an oil pump.

13. The system of claim 9, wherein the spool is connected to the control actuator for controlling movement of the spool relative to the valve sleeve based upon various engine parameters.

14. The system of claim 13 wherein said control actuator is under control of an engine control unit.

* * * * *